US007997506B2

(12) United States Patent
Kim

(10) Patent No.: US 7,997,506 B2
(45) Date of Patent: Aug. 16, 2011

(54) AIR CONDITIONING SYSTEM

(75) Inventor: Hae Jin Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 398 days.

(21) Appl. No.: 12/219,698

(22) Filed: Jul. 25, 2008

(65) Prior Publication Data

US 2009/0159716 A1 Jun. 25, 2009

(30) Foreign Application Priority Data

Dec. 21, 2007 (KR) ..... 10-2007-0135501

(51) Int. Cl.

| | |
|---|---|
| ***B60H 1/00*** | (2006.01) |
| ***G05D 23/19*** | (2006.01) |
| ***G05D 15/00*** | (2006.01) |
| ***G05D 23/00*** | (2006.01) |

(52) U.S. Cl. ..... 236/91 F; 236/51; 700/299

(58) Field of Classification Search ..... 236/51, 236/91 F, 91 D, 46 A, 46 R; 700/299
See application file for complete search history.

(56) References Cited

U.S. PATENT DOCUMENTS

| | | | | |
|---|---|---|---|---|
| 4,289,272 | A * | 9/1981 | Murase et al. | 236/91 D |
| 4,667,875 | A | 5/1987 | Strand et al. | |
| 4,824,014 | A | 4/1989 | Stuch | |

FOREIGN PATENT DOCUMENTS

| | | |
|---|---|---|
| CN | 1216813 | 5/1999 |
| CN | 1920423 | 2/2007 |

* cited by examiner

*Primary Examiner* — Chen-Wen Jiang
(74) *Attorney, Agent, or Firm* — McKenna Long & Aldridge LLP

(57) ABSTRACT

An air conditioning system can automatically increase or decrease a desired temperature of an indoor unit at a variable gradient smaller than the variable gradient per predetermined time of an outdoor temperature. Hence, the user does not have to directly change the desired temperature, thus increasing user's convenience. Also, in the event of a significant diurnal range in temperature, air conditioning sickness can be prevented since an optimum indoor temperature can be maintained. Moreover, the variable gradient of the desired temperature of a room is smaller than the variable gradient of an outdoor temperature, thus keeping the room pleasant.

20 Claims, 9 Drawing Sheets

AIR CONDITIONING SYSTEM

This nonprovisional application claims priority under 35 U.S.C. §119(a) on Patent Application No. 10-2007-0135501 filed in Republic of Korea on Dec. 21, 2007, the entire contents of which are hereby incorporated by reference.

BACKGROUND OF THE INVENTION

1. Field of the Invention

The present invention relates to an air conditioning system, and more particularly, to an air conditioning system, which can automatically increase or decrease a desired temperature of an indoor unit based on an increase or decrease in outdoor temperature.

2. Description of the Conventional Art

Generally, air conditioner is provided for cooling, heating, and air cleaning, and installed so as to discharge cool/warm air to a room and clean indoor air, thereby providing people with a more pleasant indoor environment. The air conditioner is separated into an indoor unit comprised of a heat exchanger and an outdoor unit comprised of a compressor, a heat exchanger, and so on for control purpose. Recently, there has been a wide spread of a multi-type air conditioner which is controlled by comprising an outdoor unit and a plurality of indoor units sharing the outdoor unit on one floor or in one building in order to enhance energy efficiency. Such a multi-type air conditioner uses a power divider in order to distribute power to the respective indoor units.

However, in the conventional air conditioner, a desired temperature inputted by a user or by the initial setting of the air conditioner is fixed at the time of applying power and setting a driving operation. In the event of a significant diurnal range in temperature, the difference between an indoor temperature and an outdoor temperature is not properly maintained, and this may cause an air conditioning sickness. If the desired temperature is changed during operation, the user has to directly manipulate the air conditioner to change the desired temperature, thereby increasing user's inconvenience.

SUMMARY OF THE INVENTION

It is an object of the present invention to provide an air conditioning system, which can automatically increase or decrease a desired temperature of an indoor unit based on an increase or decrease in outdoor temperature.

The present invention provides an air conditioning system, which comprises a remote controller, the remote controller comprising: an air conditioner including at least one indoor unit; an outdoor temperature detection unit for detecting an outdoor temperature of the place where the indoor unit is installed; and a control unit for calculating a deviation temperature having a predetermined deviation from the outdoor temperature detected in the outdoor temperature detecting unit, wherein the control unit varies the deviation between the outdoor temperature and the deviation temperature.

The air conditioning system according to the present invention can automatically increase or decrease a desired temperature of an indoor unit at a variable gradient smaller than the variable gradient per predetermined time of an outdoor temperature. Hence, the user does not have to directly change the desired temperature, thus increasing user's convenience. Also, in the event of a significant diurnal range in temperature, air conditioning sickness can be prevented since an optimum indoor temperature can be maintained. Moreover, the variable gradient of the desired temperature of a room is smaller than the variable gradient of an outdoor temperature, thus keeping the room pleasant.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Figure 1:
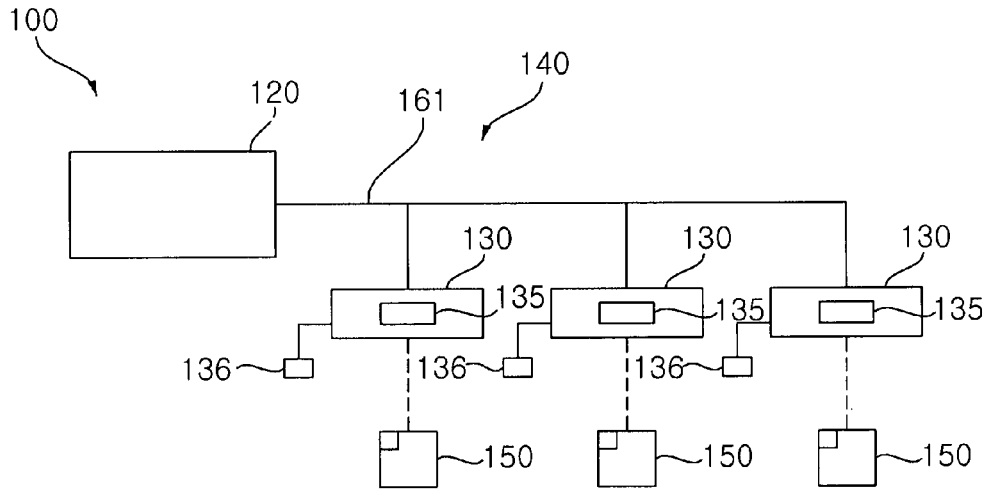
FIG. 1 is a block diagram showing the configuration of an air conditioning system in accordance with one embodiment of the present invention.
Figure 2:
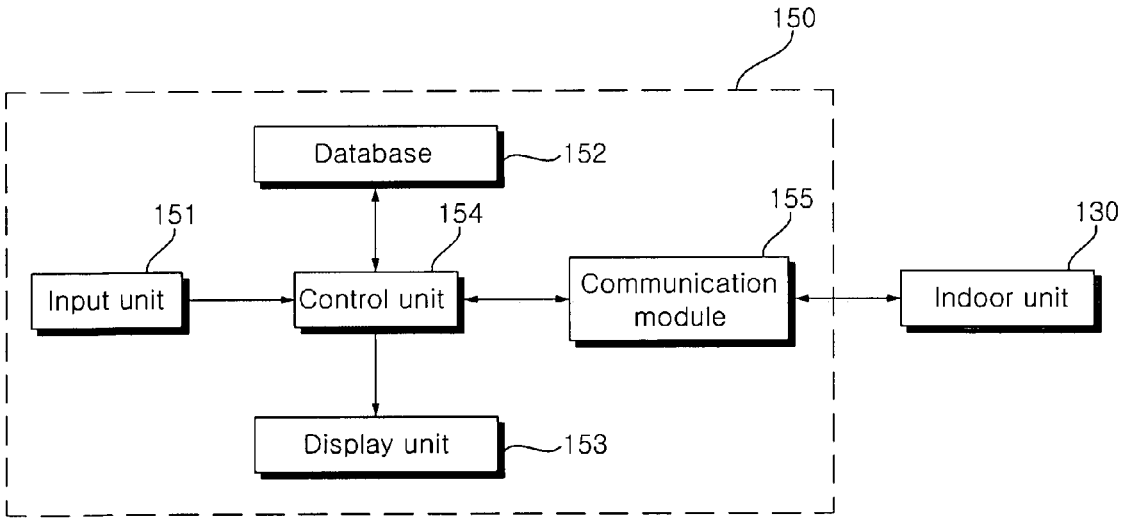
FIG. 2 is a block diagram showing the internal configuration of a remote controller as shown in FIG. 1.

FIG. 1 is a block diagram showing the configuration of an air conditioning system in accordance with one embodiment of the present invention. FIG. 2 is a block diagram showing the internal configuration of a remote controller as shown in FIG. 1.

Referring to FIG. 1, the air conditioning system 100 of the present invention includes an air conditioner 140 and a remote controller 150. The air conditioner 140 includes at least one indoor unit 130 and an outdoor unit 120. While the air conditioner 140 includes one outdoor unit 120 and one indoor unit 130, the present invention is not limited thereto. The air conditioner 140 may include one outdoor unit 120 and a plurality of indoor units 130, or include a plurality of outdoor units 120 and a plurality of indoor units 130. Each indoor unit 130 is provided with an indoor temperature sensor 135 for detecting an indoor temperature of the place where the indoor unit is placed and an outdoor temperature detecting unit 136 for detecting an outdoor temperature of the place where the indoor unit 130 is installed. The outdoor temperature detecting unit 136 may be an outdoor temperature sensor which is provided separately for each indoor unit 130 and attached to the outside of the indoor unit 130 to detect an outdoor temperature.

The indoor units 130 are respectively disposed in indoor spaces, and the outdoor unit 120 is disposed in an outdoor space. The indoor units 130 and the outdoor unit 120 are communicatively connected to each other via a network 161. RS-485 communication is performed over the network 161. However, the present invention is not limited to the above communication method.

Referring to FIG. 1, respective remote controllers 150 are disposed in respective indoor spaces, and each of the remote controllers 150 manipulates operational information of the air conditioner 140 by communication with the indoor unit 130 disposed in an indoor space. The remote controller 150 and the indoor unit 130 perform communication by wires or wireless, and the remote controller 150 may be a wired remote control or wireless remote control.

Referring to FIG. 2, the remote controller 150 includes an input unit 151, a display unit 153, a database 152, a communication module 155, and a control unit 154.

The communication module 155 of the remote controller 150 can transmit a control signal for controlling the operation of the air conditioner 140 or receive operational information of the air conditioner 140 through data communication with a communication module (not shown) provided in the indoor unit 130.

The database 152 stores image data to be displayed on the display unit 153 to be described later, and stores operating conditions of the air conditioner 140 received via the communication module 155. Also, changes in outdoor temperature detected through the outdoor temperature detecting unit 136 are stored, and the control unit 154 increases or decreases a desired temperature of the indoor unit 130 based on an increase or decrease in outdoor temperature detected in the outdoor temperature detecting unit 136.

Figure 3:
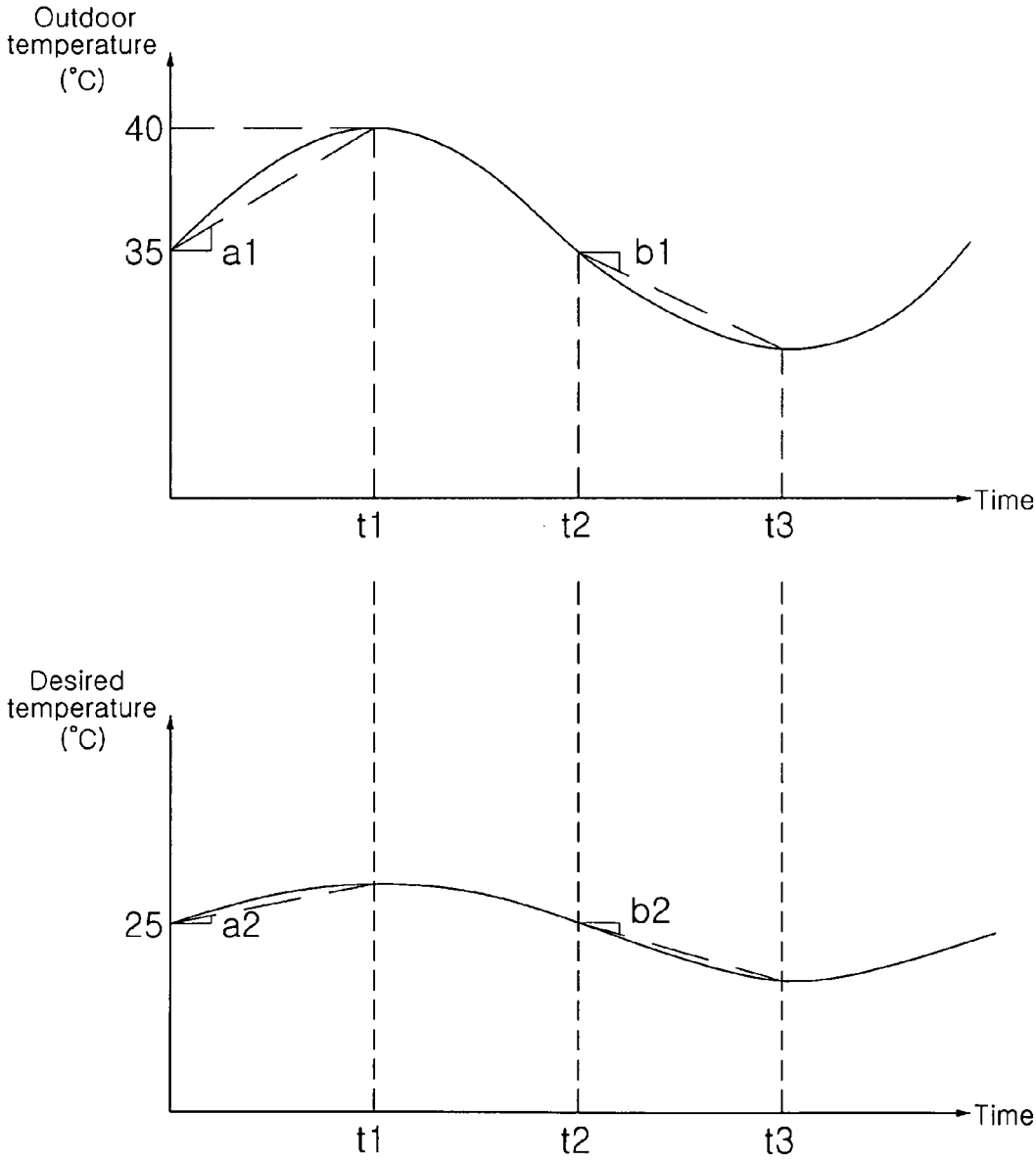
FIG. 3 is a graph for explaining an operation of increasing or decreasing a temperature based on an increase or decrease in outdoor temperature in accordance with one embodiment of the present invention.

FIG. 3 is a graph for explaining an operation of increasing or decreasing a temperature based on an increase or decrease in outdoor temperature in accordance with one embodiment of the present invention. Referring to FIG. 3, an outdoor temperature increases or decreases with the passage of time, and the control unit 154 increases or decreases a desired temperature in response to an increase or decrease in outdoor temperature. Here, the control unit 154 varies the desired temperature at a variable gradient smaller than the variable gradient per predetermined time of the outdoor temperature.

Referring to FIG. 3, as time passes from 0 to 1, the outdoor temperature rises at a variable gradient of a1. While the same time passes, the desired temperature rises at a variable gradient of a2. Here, the variable gradient of a2 is smaller than the variable gradient of a1. In the event that the desired temperature is varied with the rise of the outdoor temperature, if the desired temperature is raised at a variable gradient same as or greater than the variable gradient of the outdoor temperature, the desired temperature of the room rises at a width same as or greater than the change of the outdoor temperature with the rise of the outdoor temperature. As the rise width of the desired temperature becomes greater, the rise width of the indoor temperature also become greater, thereby lowering the feeling of comfort of the user. Therefore, air conditioning sickness that may occur in the event of a significant diurnal range in temperature can be prevented by varying a desired temperature according to a change in outdoor temperature, and the room can be kept pleasant by varying a desired temperature at a variable gradient smaller than the variable gradient of the outdoor temperature.

Referring to FIG. 3, when the outdoor temperature falls at a variable gradient of b1 while time passes from t2 to t3, as well as when the outdoor temperature increases, the desired temperature falls at a variable gradient of b2 which is smaller than b1, the effect of which is as described above.

Figure 4:
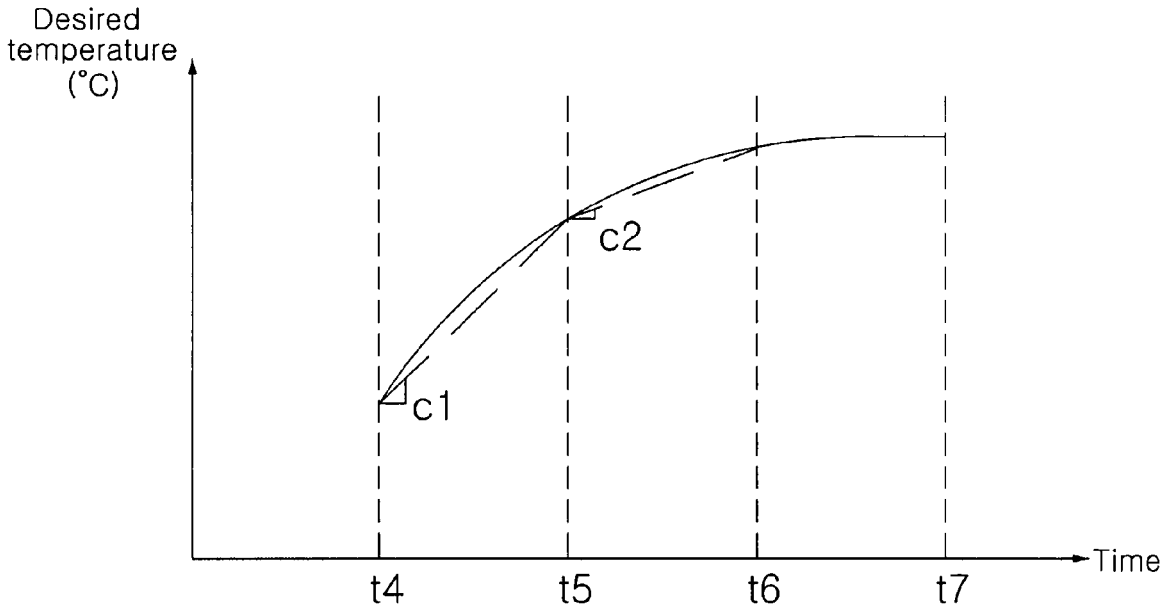
FIG. 4 is a graph for explaining an operation in which a desired temperature rises in accordance with one embodiment of the present invention.
Figure 5:
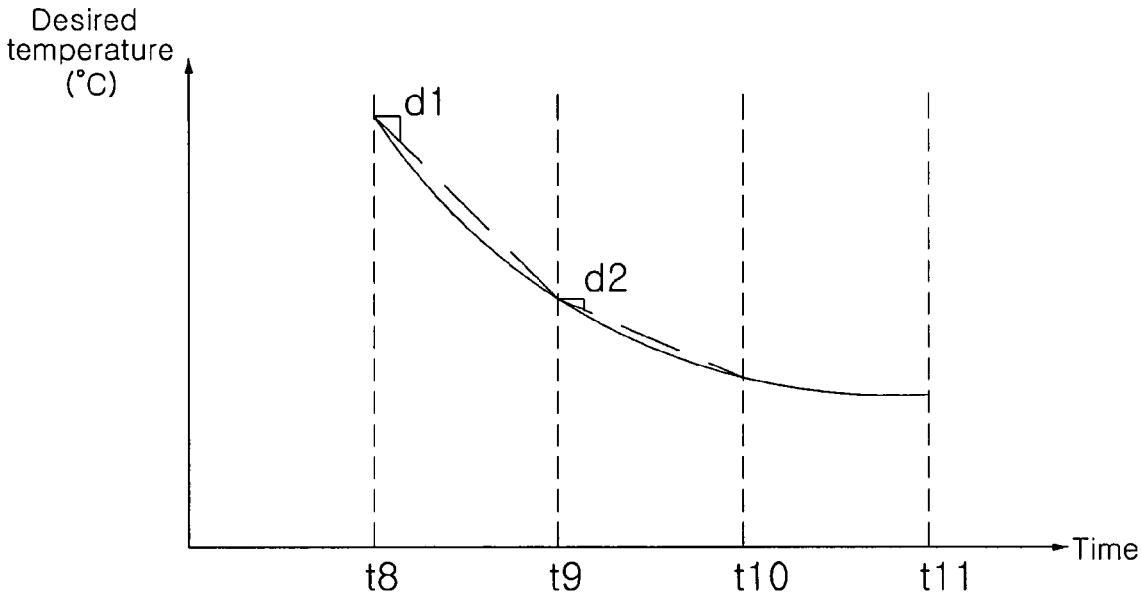
FIG. 5 is a graph for explaining an operation in which a desired temperature falls in accordance with one embodiment of the present invention.

FIG. 4 is a graph for explaining an operation in which a desired temperature rises in accordance with one embodiment of the present invention. FIG. 5 is a graph for explaining an operation in which a desired temperature falls in accordance with one embodiment of the present invention. Referring to FIG. 4, in an interval where the desired temperature varies with time, there exists a rising period, i.e., a period in which time passes from t4 to t7, and the variable gradient at one segment of the rising period may be different from the variable gradient at other segments of the rising period. Concretely, as time passes from t3 to t5, the desired temperature may rise at a variable gradient of c1. However, the desired temperature does not continuously rise at the same variable gradient, but may rise at a variable gradient of c2, which is smaller than c1, even in the same rising period, while time passes from t5 to t6. Accordingly, it is not that the desired temperature as well rises at a constant variable gradient according to the variation of the outdoor temperature, but there may exist a segment where the desired temperature rises at a different variable gradient even in the same rising period. Thus, the control unit 14 can adjust the desired temperature so as to avoid the desired temperature from rising substantially. Consequently, the pleasantness of the room can be maintained within a predetermined range by varying the rising gradient of the desired temperature.

Referring to FIG. 5, in an interval where the outdoor temperature falls and the desired temperature varies with time, as well as when the desired temperature increases, a falling period exists, and the variable gradient at one segment of the falling period may be different from the variable gradient at other segments of the falling period. That is, in an interval where the desire temperature varies with time, a falling period, i.e., a period in which time passes from t4 to t7, exists, and the desired temperature may fall at a falling gradient of d2, which is smaller than d1, even in the same falling period, while time passes from t9 to t10. Consequently, the pleasantness of the room can be maintained within a predetermined range by varying the falling gradient of the desired temperature.

Figure 6:
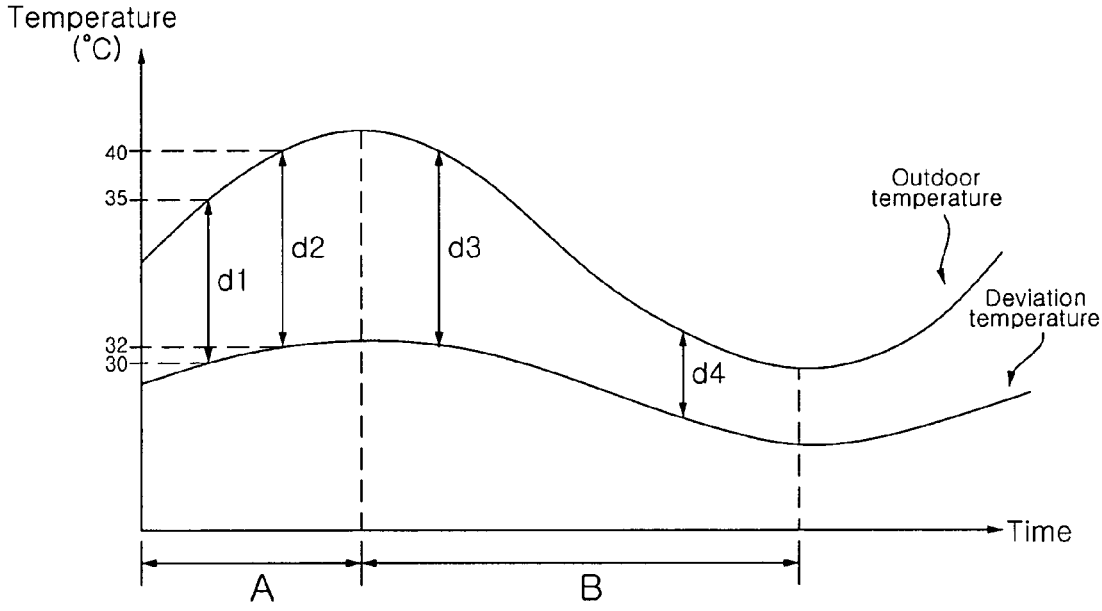
FIG. 6 is a graph for explaining an operation in which a deviation temperature increases or decreases based on an increase or decrease in outdoor temperature in a cooling mode of an indoor unit in accordance with another embodiment of the present invention.

FIG. 6 is a graph for explaining an operation in which a deviation temperature increases or decreases based on an increase or decrease in outdoor temperature in a cooling mode of an indoor unit 130 in accordance with another embodiment of the present invention.

Referring to FIG. 6, the control unit 154 calculates a deviation temperature having a predetermined deviation from an outdoor temperature detected in the outdoor temperature detecting unit 136, and compares the deviation temperature and a desired temperature to set a new desired temperature. That is to say, in the event that a desired temperature is varied, the desired temperature is not calculated immediately with the variation of an outdoor temperature, but a deviation temperature is calculated, and then the calculated deviation temperature and the current desired temperature are compared to thus calculate a new desired temperature. Here, as the outdoor temperature varies, the control unit 154 varies the deviation between the outdoor temperature and the deviation temperature.

Referring to FIG. 6, if the indoor unit 130 performs a cooling operation, the outdoor temperature varies along a predetermined rising period A and falling period B. First, in the interval A in which the outdoor temperature rises, the control unit calculates a deviation temperature having a predetermined deviation d1 and d2 from the outdoor temperature. For example, if the current desired temperature is 25° C. and the outdoor temperature at a specific time of the interval A is 35° C. and 40° C., respectively, d1 may be set to 5° C. and d2 may be set to 8° C. In this case, the deviation temperature is 30° C. (35−5) and 32° C. (40−8), respectively. That is, with the rise of the outdoor temperature, the deviation is varied from d1 (5° C.) to d2 (8° C.), and the deviation temperature also increases from 30° C. to 32° C. In other words, even if the outdoor temperature rises, a deviation temperature having the same deviation as that of the outdoor temperature is not calculated, but the deviation is varied and then a deviation temperature is calculated.

The control unit 154 compares the calculated deviation temperature and the current desired temperature of 25° C., and sets the larger value as a new desired temperature. That is, if the desired temperature of 25° C. and the calculated temperature of 30° C. are compared with each other, the deviation temperature is the larger value, and hence the deviation temperature (30° C.) is set as a new desired temperature. Likewise, even when the newly calculated deviation temperature is 32° C. after the passage of time, the deviation temperature is the larger value, and hence the deviation temperature (32° C.) is set as a new desired temperature. The reason why the deviation temperature and the current desired temperature are compared with each other and the larger value is set as a new desired temperature is because in the event of the cooling mode of the indoor unit 130, it is possible to prevent the desired temperature from being set too low, thus preventing the room from being too cold and resultantly preventing an increase of power consumption of the indoor unit.

Referring to FIG. 6, as the outdoor temperature rises, the deviation becomes larger. That is to say, in the interval A of FIG. 6, d2 becomes larger than d1 with the rise of the outdoor temperature, and hence the rise width of the deviation temperature becomes smaller than the rise width of the outdoor temperature. Therefore, when setting a new desired temperature based on the deviation temperature, the new desired temperature can be maintained not to change substantially, thereby keeping the room pleasant.

Referring to FIG. 6, as the outdoor temperature falls, the deviation becomes smaller. That is to say, in the interval B of FIG. 6, d4 becomes smaller than d3 with the fall of the outdoor temperature, and hence the fall width of the deviation temperature becomes smaller. Therefore, when setting a new desired temperature based on the deviation temperature, the new desired temperature can be maintained not to change substantially, thereby keeping the room pleasant.

Figure 7:
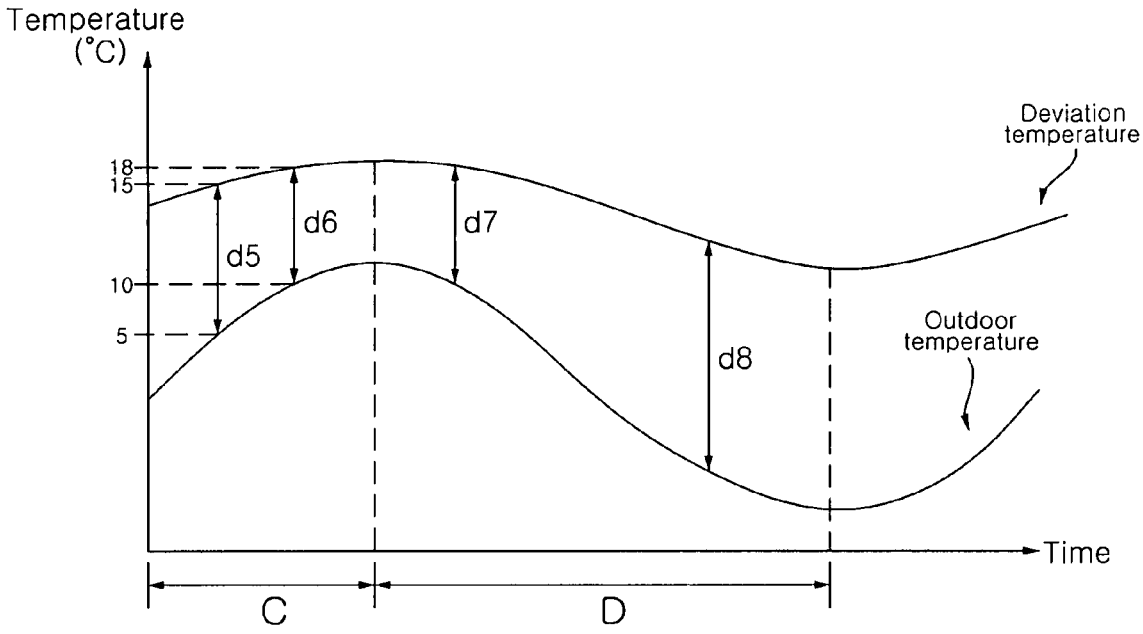
FIG. 7 is a graph for explaining an operation in which a deviation temperature increases or decreases based on an increase or decrease in outdoor temperature in a heating mode of an indoor unit in accordance with still another embodiment of the present invention.

FIG. 7 is a graph for explaining an operation in which a deviation temperature increases or decreases based on an increase or decrease in outdoor temperature in a heating mode of an indoor unit in accordance with still another embodiment of the present invention.

Referring to FIG. 7, the control unit 154 calculates a deviation temperature having a predetermined deviation d5, d6, d7, and d8 from an outdoor temperature detected in the outdoor temperature detecting unit 136, and compares the deviation temperature and a desired temperature to set a new desired temperature, which is the same as in the above-described cooling operation.

In the heating operation as well, as the outdoor temperature varies, the control unit 154 varies the deviation between the outdoor temperature and the deviation temperature. Referring to FIG. 7, if the indoor unit 130 performs a heating operation, the outdoor temperature varies along a predetermined rising period C and falling period D. First, in the interval D in which the outdoor temperature rises, the control unit calculates a deviation temperature having a predetermined deviation d5 and d6 from the outdoor temperature. For example, if the current desired temperature is 20° C. and the outdoor temperature at a specific time of the interval C is 5° C. and 10° C., respectively, d5 may be set to 10° C. and d6 may be set to 8° C. In this case, the deviation temperature is 15° C. (5+10) and 18° C. (10+8), respectively. That is, with the rise of the outdoor temperature, the deviation is varied from d5 (10° C.) to d6 (8° C.), and the deviation temperature also increases from 15° C. to 18° C. In other words, even if the outdoor temperature rises, a deviation temperature having the same deviation as that of the outdoor temperature is not calculated, but the deviation is varied and then a deviation temperature is calculated.

The control unit 154 compares the calculated deviation temperature and the current desired temperature of 20° C., and sets the smaller value as a new desired temperature. That is, if the desired temperature of 20° C. and the calculated temperature of 15° C. are compared with each other, the deviation temperature is the smaller value, and hence the deviation temperature (15° C.) is set as a new desired temperature. Likewise, even when the newly calculated deviation temperature is 18° C. after the passage of time, the deviation temperature is the larger value than the desired temperature of 20° C., and hence the deviation temperature (18° C.) is set as a new desired temperature. The reason why the deviation temperature and the current desired temperature are compared with each other and the larger value is set as a new desired temperature is because in the event of the heating mode of the indoor unit 130, it is possible to prevent the desired temperature from being set too high, thus preventing the room from being too hot and resultantly preventing an increase of power consumption of the indoor unit.

Referring to FIG. 7, as the outdoor temperature rises, the deviation becomes larger. That is to say, in the interval C of FIG. 7, d6 becomes smaller than d5 with the rise of the outdoor temperature, and hence the rise width of the deviation temperature becomes smaller than the rise width of the outdoor temperature. Therefore, when setting a new desired temperature based on the deviation temperature, the new desired temperature can be maintained not to change substantially, thereby keeping the room pleasant.

Referring to FIG. 7, as the outdoor temperature falls, the deviation becomes larger. That is to say, in the interval D of FIG. 7, d8 becomes smaller than d7 with the fall of the outdoor temperature, and hence the fall width of the deviation temperature becomes smaller. Therefore, when setting a new desired temperature based on the deviation temperature, the new desired temperature can be maintained not to change substantially, thereby keeping the room pleasant.

Figure 8:
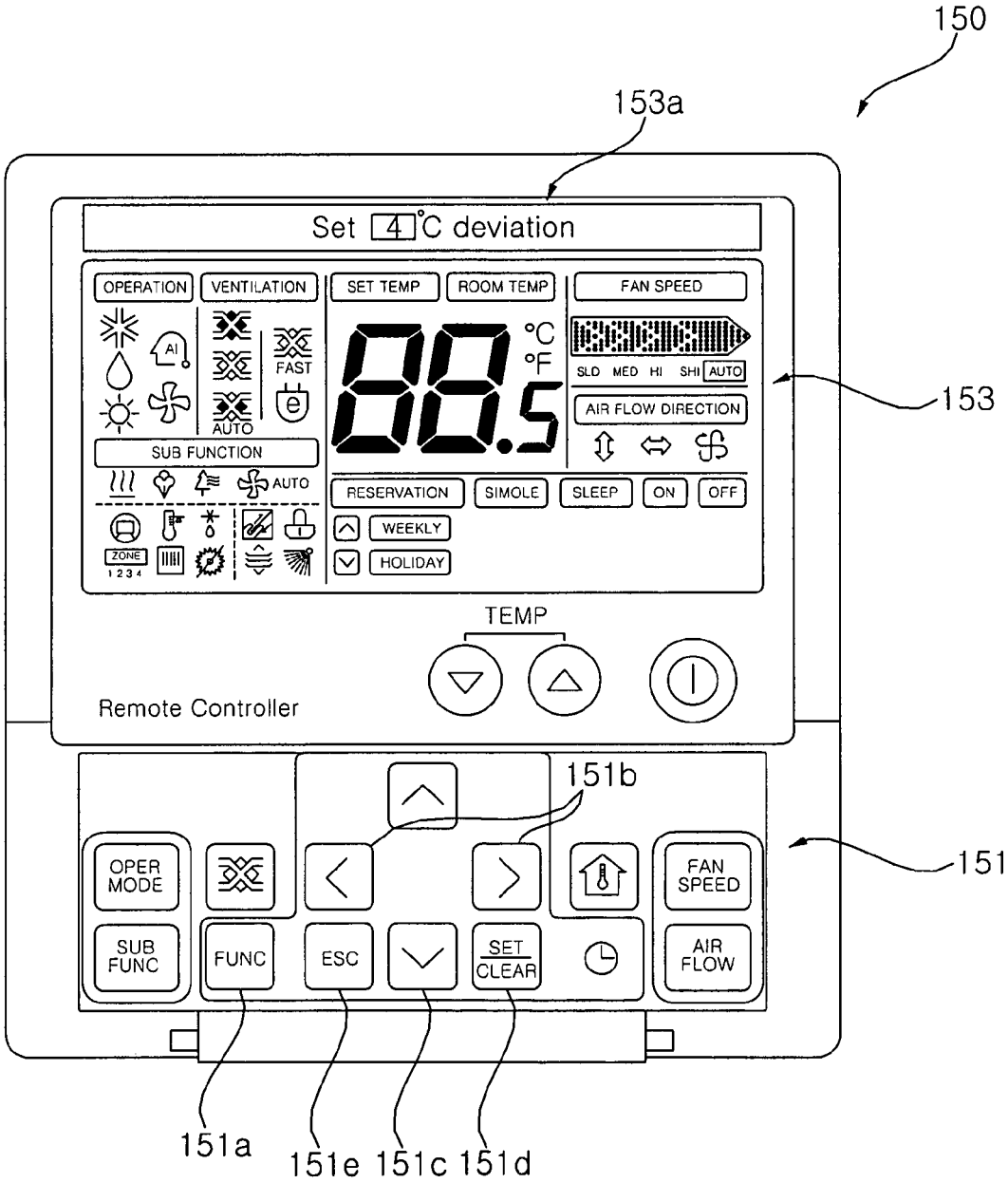
FIG. 8 is a plan view showing an input unit and a display unit of the remote controller as shown in FIG. 1.

FIG. 8 is a plan view showing an input unit and a display unit of the remote controller as shown in FIG. 1. Referring to FIG. 8, the user inputs a manipulation signal to manipulate operating conditions of the air conditioner through the input unit 151. As stated above, the remote controller 150 may be a wired remote control or wireless remote control, and the input unit 151 may be a plurality of function keys provided at the wired remote control or wireless remote control.

The plurality of function keys operable by the user include a first function key 151*a* for inputting a manipulation signal to enter a predetermined setting mode, second function keys 151*b* and 151*c* for indicating a predetermined direction, a third function key 151*d* for indicating set/clear, a fourth key 151*e* for indicating exit, and sub function keys.

At least one of a desired temperature of the indoor unit 130 and an initial value of the deviation (d1 and d2 of FIG. 5) is inputtable based on the manipulation signal inputted from the input unit 151. Referring to FIG. 8, when the user presses the first function key 51*a*, a temperatures setting mode for inputting a desired temperature or an initial value of the deviation is entered. In FIG. 8, the temperature setting mode for inputting a deviation is entered by the user's pressing the first function key 151*a* on the display window 153*a* of the display unit 153. The user can select a desired temperature or an initial value of the deviation by pressing the second function keys 151*b* and 151*c* to move the cursor up and down or left and right. When a desired temperature or an initial value of the deviation is selected, the user presses the third function key 151*d* to complete setting.

The display unit 153 displays operational information of the air conditioner 140. The display unit 153 displays operating conditions of the air conditioner 140 in various images. Concretely, the display window 153*a* of the display unit 153 has an LCD panel structure, and the LCD panel structure is an FSTN (Film Super Twist Nematics). The LCD panel structure is divided into a TN LCD (Twsited Nematic LCD), a CTN (Complementary Tn), an STN (Super Twisted Nematic), a DSTN (Double Layer Super Twisted Nematic), an FSTN (Film Super Twist Nematics) and so forth depending on the physical properties of liquid crystal, the material of the panel, etc. The FSTN type uses a very thin polymerized film in place of a color compensating liquid crystal cell, and the display window 153*a* of the display unit 153 of the present invention employs an LCD panel structure of FSTN type that can obtain a wide view angle and is suitable for thinning. An image represented on the display window 153*a* of the display unit 153 is a set of dots which is represented as one dot on the coordinate plane. That is, display window 153*a* of the display unit 153 is a dot type LCD which represents an image in the set of dots, and can represent image data as an image by lighting the dots with the use of the image data stored in the database 152.

As a desired temperature varies, the display unit 153 displays the varied desired temperature. Unlike a variable gradient of an outdoor temperature or a variable value of a deviation temperature, a varied desired temperature is information in which the user is mainly interested, and information about a desired temperature varied in real time can be provided through the display unit 153.

Meanwhile, each indoor unit 130 is provided with an indoor temperature sensor 135 for detecting an indoor temperature of the place where the indoor unit is placed, and the control unit 154 varies the indoor temperature detected in the indoor temperature sensor 135 within a predetermined upper limit and lower limit range. That is, even if a new desired temperature is set due to the variation of a desired temperature or the variation of a deviation temperature, the indoor temperature is varied within the predetermined upper limit and lower limit range. Thus, even on a day with a large diurnal range in temperature, the temperature of a room can be maintained within a given range, thereby keeping the room pleasant.

Figure 9:
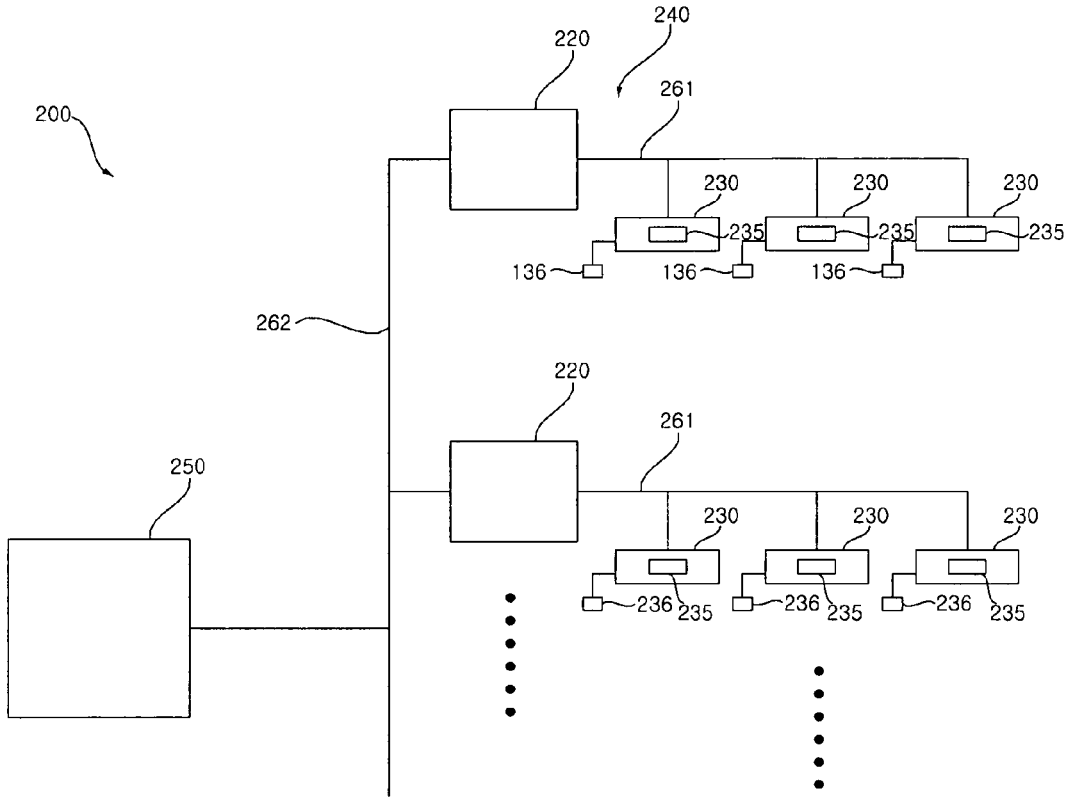
FIG. 9 is a block diagram showing the configuration of an air conditioning system in accordance with another embodiment of the present invention.

FIG. 9 is a block diagram showing the configuration of an air conditioning system in accordance with another embodiment of the present invention. The following description will be focused on differences from the foregoing embodiment.

Referring to FIG. 9, the air conditioning system 200 includes an air conditioner 240 and a remote controller 250. The air conditioner 240 includes a plurality of indoor units 230 and an outdoor unit 220. The indoor units 230 and the outdoor unit 220 are communicatively connected to each other via a first network 261. Also, the outdoor units 220 are communicative connected to each other via a second network 262. RS-485 communication is performed over the first network 261 and RS-485 communication is performed over the second network 262. However, the present invention is not limited to the above communication method. The remote controller 250 is communicatively connected to the air conditioners 240 via the second network 262.

A control unit (not shown) of the remote controller 250 selects a representative indoor unit among the indoor units 230, and varies a desired temperature of the representative indoor unit at a variable gradient smaller than the variable gradient per predetermined time of the outdoor temperature of the representative indoor unit. Based on the variation of the desired temperature of the representative indoor unit, desired temperatures of the other indoor units 230 are varied. That is, although all of the respective indoor units 230 may detect an outdoor temperature respectively, and varies the desired temperatures of the respective indoor units 230 independently, it may also be possible to vary the desired temperatures of the other indoor units 230 in the same way depending on the variation of the desired temperature of the representative indoor unit by selecting the representative indoor unit. The desired temperature of the representative indoor unit is a temperature commonly applied to the entire indoor units 230, and is inputtable through an input unit (not shown) of the remote controller 250.

In case of selecting a representative indoor unit, the control unit (not shown) is able to select a representative indoor unit based on the indoor unit addresses allocated to the plurality of indoor units 230. In this case, although the control unit (not shown) may select a representative indoor unit commonly applied for all of the indoor units 230, it may also be possible to select a representative indoor unit among the indoor units 230 currently in operation. Hereinafter, a method for selecting a representative indoor unit will be explained.

First, indoor unit addresses are respectively allocated to the plurality of indoor units 230. This is because the remote controller 250 needs to recognize the respective indoor units 230 in order to perform data communication with the respective indoor units 230. Since the indoor unit addresses have a different value, the remote controller 250 can perform communication with the indoor units 230 by using the indoor unit addresses.

In order to allocate an indoor unit address to each indoor unit 230, generally, an installer or user can directly move to the places where each indoor unit 230 is installed, and set addresses by a remote control connected to the corresponding indoor unit 230. However, this causes the installer or user's inconvenience of having to directly moving. Thus, for the indoor unit address of the present invention, the outdoor unit 220 provided with an automatic address setting function is used, thereby increasing user convenience.

Figure 10:
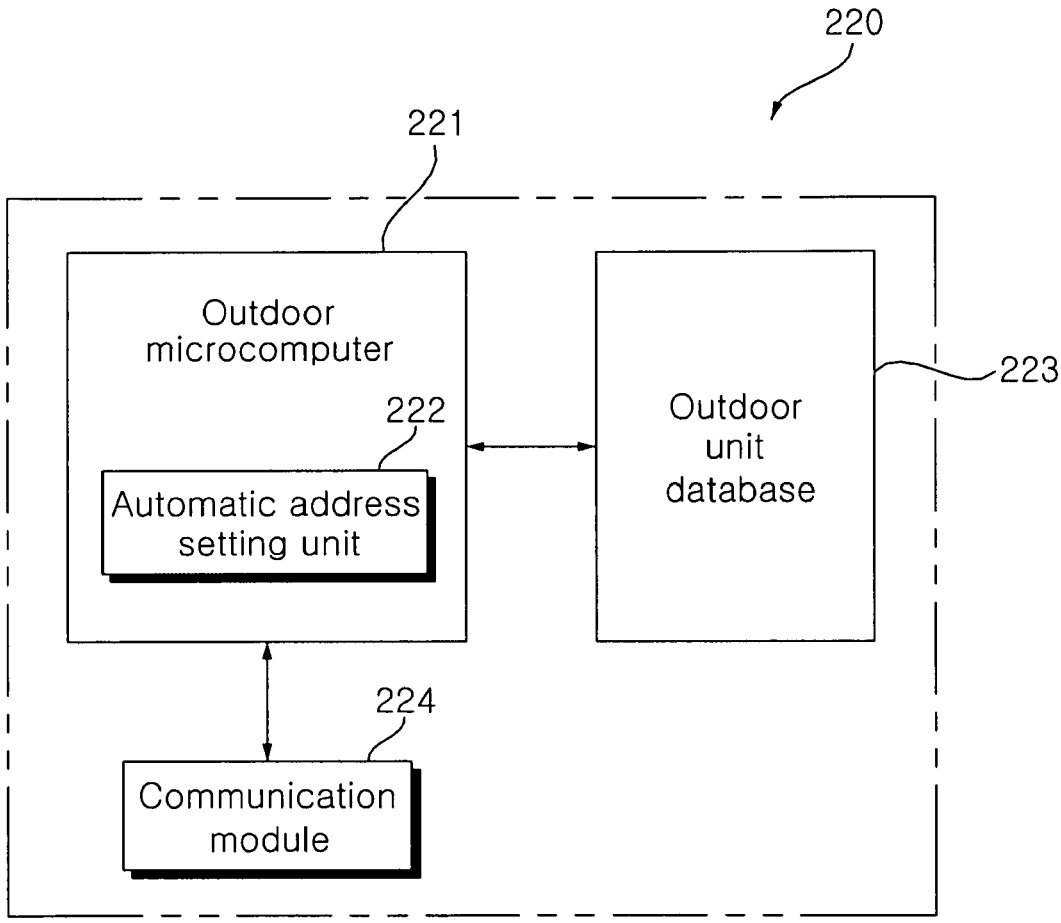
FIG. 10 is a block diagram showing the internal configuration of an outdoor unit as shown in FIG. 9.

FIG. 10 is a block diagram showing the internal configuration of the outdoor unit as shown in FIG. 9. Referring to FIG. 10, the outdoor unit 220 includes an outdoor unit database 223 for storing address data of the indoor units 230, a communication module 224 connected to the indoor units 230 for sending and receiving data, and an outdoor microcomputer 221 for automatically allocating indoor unit addresses to the indoor units 230 according to a request from the control unit (not shown). The outdoor unit database 223 stores the indoor unit addresses of the indoor units connected to the outdoor unit 220, and stores an automatic address setting program for allocating the addresses of the indoor units 230. The outdoor unit microcomputer 122 includes an automatic address setting unit 222 for allocating the addresses of the indoor units 230 connected to the outdoor unit 220. The control unit (not shown) of the remote controller 240 transmits, to the outdoor unit 220, a request signal for automatically allocating the addresses of the indoor units 230. When the request signal is received, the automatic address setting unit 222 operates the automatic address setting program stored in the outdoor unit database 223 to allocate the address values for the respective indoor units 230 connected to the outdoor unit 220. For example, if 16 indoor units 230 are connected to the outdoor unit 220, the automatic address setting unit 222 sequentially allocates address values for the indoor units 230 in the order of higher values, like 'indoor unit 1(IDU1)', 'indoor unit 2(IDU2)', . . . 'indoor unit 16(IdU16)'. The outdoor unit microcomputer 221 stores address data of the indoor units 230 allocated through the automatic address setting unit 222 in the outdoor unit database 223, and transmits them to the respective indoor units 230. Moreover, the outdoor unit microcomputer 221 transmits the stored data of the respective indoor units to the remote controller 250 according to a request from the control unit (not shown) of the remote controller 250, and the indoor unit address data is stored in the database (not shown) of the remote controller 250.

After the indoor unit addresses are allocated to the respective indoor units 230 of the air conditioner 240, the control unit (not shown) of the remote controller 250 selects a representative indoor unit among the indoor units 230. The control unit (not shown) is able to select, as the representative indoor unit, an arbitrary one of all the indoor units 230 allocated with the indoor unit addresses. The arbitrary indoor unit may be an indoor unit having the smallest value of the indoor unit address or an indoor unit corresponding to the indoor unit address firstly registered in the database (not shown) of the remote controller according to the user's selection.

Meanwhile, the control unit (not shown) may select, as the representative indoor unit, an arbitrary one of the indoor units 230 in operation, among the indoor units 230 allocated with the indoor unit addresses. That is, if the representative indoor unit is selected among all the indoor units 230 allocated with the indoor unit addresses, the indoor unit currently being stopped in operation may be selected as the representative indoor unit. Hence, by selecting the representative indoor unit among the indoor units 230 currently in operation, the accuracy of variation of a desired temperature can be ensured. As described above, the arbitrary indoor unit may be an indoor unit having the smallest value of the indoor unit address or an indoor unit corresponding to the indoor unit address firstly registered in the database (not shown) of the remote controller according to the user's selection.

Although the control unit (not shown) may automatically select the representative indoor unit based on the indoor unit addresses, it is possible for the user to directly select an arbitrary one of all the indoor units 230 or of the indoor units 230 in operation as the representative indoor unit based on a manipulation signal inputted from the input unit (not shown) of the remote controller 250.

Meanwhile, the control unit (not shown) can calculate the average value of the variable gradients per predetermined time of the outdoor temperature of the places where the indoor units 230 are installed, and vary the desired temperatures of the indoor units 230 at a variable gradient smaller than the average value of the variable gradients per predetermined time of the outdoor temperature. In other words, the average value of the variable gradients per predetermined time of the outdoor temperature of the places where the indoor units 230 are installed is calculated so that the desired temperatures of the indoor units 230 can be collectedly varied, rather than each indoor unit 230's individually performing the control for varying a desired temperature. Here, the control unit (not shown) may calculate the average value of the variable gradients per predetermined time of the outdoor temperature of the places where all the indoor units 230 are installed, or calculate the average value of the variable gradients per predetermined time of the outdoor temperature of the places where the indoor units 230 in operation are installed.

Meanwhile, the outdoor unit 120 as shown in FIG. 1 is provided with a compressor (not shown) capable of varying the capacity. Here, the compressor may be comprised of an inverter compressor so as to compress a different amount of refrigerant depending on a required air conditioning heat quantity.

As the outdoor temperature detected in the outdoor temperature detecting unit 136 varies, the control unit 154 varies the operation factor of the compressor according to a cooling mode or heating mode when varying a desired temperature. Here, the compressor is an inverter compressor, and if the operation factor of the compressor is varied, the control unit 154 adjusts the operating frequency of the inverter compressor. Concretely, the control unit 154 varies the operating frequency for controlling the compressor in order to vary the capacity of the inverter compressor. The inverter compressor can quickly create a user-desired air conditioning environment because the number of rotations can be varied, and can eliminate noise generated upon switching on/off the compressor because a require amount of refrigerant can be compressed without the on/off control of the compressor. By the operating frequency for controlling the compressor, the number of rotations of the inverter compressor, the compression amount of refrigerant, and the air conditioning heat quantity of the air conditioner can be adjusted. As a result, the operation states of the indoor units 130 can be controlled by the control unit 154 by varying the operating frequency of the inverter compressor.

In the cooling mode, if a new desired temperature is lower than the previous desired temperature, because the load is increased, the control unit 154 increases the operation factor of the compressor, and if a new desired temperature is higher than the previous desired temperature, because the load is decreased, the control unit 154 decreases the operation factor of the compressor. Likewise, in the heating mode, if a new desired temperature is lower than the previous desired temperature, because the load is decreased, the control unit 154 decreases the operation factor of the compressor, and if a new desired temperature is higher than the previous desired temperature, because the load is increased, the control unit 154 increases the operation factor of the compressor.

Although the present invention has been described with reference to the embodiments shown in the drawings, these are merely illustrative, and those skilled in the art will understand that various modifications and equivalent other embodiments of the present invention are possible. Consequently, the true technical protective scope of the present invention must be determined based on the technical spirit of the appended claims.

What is claimed is:

1. An air conditioning system, comprising:

an air conditioner including at least one indoor unit;

an outdoor temperature detection unit for detecting an outdoor temperature; and a remote controller including a control unit for increasing or decreasing a desired temperature of the indoor unit based on an increase or decrease in the outdoor temperature detected by the outdoor temperature detecting unit, wherein the control unit varies the desired temperature at a variable gradient smaller than a variable gradient per predetermined time of the outdoor temperature, wherein the variable gradient of the outdoor temperature becomes greater as a variation rate of the outdoor temperature per predetermined time becomes greater, and the variable gradient of the desired temperature is changed according to the variable gradient of the outdoor temperature.

2. The air conditioning system of claim 1, wherein a rising period exists in an interval where the desired temperature varies with time, and the variable gradient at one segment of the rising period is different from the variable gradient at other segments of the rising period.

3. The air conditioning system of claim 1, wherein a falling period exists in an interval where the desired temperature varies with time, and the variable gradient at one segment of the falling period is different from the variable gradient at other segments of the falling period.

4. The air conditioning system of claim 1, wherein the indoor unit is provided with an indoor temperature sensor for detecting an indoor temperature, and the indoor temperature detected by the indoor temperature sensor is varied between a predetermined upper limit and lower limit range.

5. The air conditioning system of claim 1, further comprising a compressor capable of varying a capacity, wherein, upon varying a desired temperature with the variation of the outdoor temperature detected by the outdoor temperature detecting unit, in a cooling mode, if a new desired temperature is lower than a previous desired temperature, the control unit increases an operation factor of the compressor, and if a new desired temperature is higher than the previous temperature, the control unit decreases the operation factor of the compressor.

6. The air conditioning system of claim 1, further comprising a compressor capable of varying a capacity, wherein, upon varying a desired temperature with the variation of the outdoor temperature detected by the outdoor temperature detecting unit, in a cooling mode, if a new desired temperature is lower than a previous desired temperature, the control unit increases an operation factor of the compressor, and if a new desired temperature is higher than the previous temperature, the control unit decreases the operation factor of the compressor.

7. The air conditioning system of claim 1, further comprising an inverter compressor capable of varying a capacity, wherein the control unit varies an operation factor of the compressor by varying an operating frequency of an inverter compressor.

8. An air conditioning system, comprising:

an air conditioner including at least one indoor unit;

an outdoor temperature detection unit for detecting an outdoor temperature; and a remote controller including a control unit for calculating a deviation temperature having a predetermined deviation from the outdoor temperature detected by the outdoor temperature detecting unit, wherein the control unit varies the deviation between the outdoor temperature and the deviation temperature, wherein the variable gradient of the outdoor temperature becomes greater as a variation rate of the outdoor temperature per predetermined time becomes greater, and the variable gradient of the desired temperature is changed according to the variable gradient of the outdoor temperature.

9. The air conditioning system of claim 8, wherein, if the indoor unit performs a cooling operation, the control unit compares the deviation temperature and the current desired temperature, and sets the larger value among the deviation temperature and the current desired temperature as the new desired temperature, and the deviation becomes larger with a rise of the outdoor temperature, and the deviation becomes smaller with a fall of the outdoor temperature.

10. The air conditioning system of claim 8, wherein, if the indoor unit performs a heating operation, the control unit compares the deviation temperature and the current desired temperature, and sets the smaller value among the deviation temperature and the current desired temperature as a new desired temperature, and the deviation becomes smaller with the rise of the outdoor temperature, and the deviation becomes larger with a fall of the outdoor temperature.

11. The air conditioning system of claim 8, wherein the remote controller further includes an input unit for inputting a manipulation signal to manipulate operating conditions of the air conditioner, and at least one of the desired temperature and an initial value of the deviation is inputtable based on the manipulation inputted from the input unit.

12. The air conditioning system of claim 11, wherein the remote controller is a wired remote control or wireless remote control, and the input unit is a plurality of function keys provided at the wired remote control or wireless remote control.

13. The air conditioning system of claim 12, wherein the plurality of function keys include a first function key for inputting a manipulation signal to enter a temperature setting mode, a second function key for indicating a predetermined direction, and a third function key for indicating set/clear, and a user presses the first function key to enter a temperature setting mode, presses the second function key to select an initial value of the desired temperature or the deviation, and presses the third function key to complete setting.

14. An air conditioning system, comprising:

an air conditioner including a plurality of indoor units;

an outdoor temperature detection unit for detecting an outdoor temperature; and a remote controller including a control unit for increasing or decreasing desired temperatures of the indoor units based on an increase or decrease in the outdoor temperature detected by the outdoor temperature detecting unit, wherein the control unit selects a representative indoor unit among the indoor units, varies the desired temperature of the representative indoor unit at a variable gradient smaller than a variable gradient per predetermined time of the outdoor temperature, and varies desired temperatures of the other indoor units based on the variation of the desired temperature of the representative indoor unit.

15. The air conditioning system of claim 14, wherein indoor unit addresses are respectively allocated to the plurality of indoor units, and the control unit selects the representative indoor unit based on indoor unit addresses of all the indoor units.

16. The air conditioning system of claim 14, wherein indoor unit addresses are respectively allocated to the plurality of indoor units, and the control unit selects the representative indoor unit based on the indoor unit addresses of the indoor units in operation.

17. The air conditioning system of claim 14, further comprising an input unit for inputting a manipulation signal to manipulate operating conditions of the air conditioner, wherein an arbitrary one of all the indoor units or of the indoor units in operation can be selected as the representative indoor unit based on the manipulation signal inputted from the input unit.

18. An air conditioning system, comprising:

an air conditioner including a plurality of indoor units;

an outdoor temperature detection unit for detecting an outdoor temperature; and a remote controller including a control unit for increasing or decreasing desired temperatures of the indoor units based on an increase or decrease in the outdoor temperature detected by the outdoor temperature detecting unit, wherein the control unit calculates an average value of variable gradients per predetermined time of the outdoor temperature of places where the indoor units are installed, and varies the desired temperatures of the indoor units at a variable gradient smaller than the average value of the variable gradients per predetermined time of the outdoor temperature.

19. The air conditioning system of claim 18, wherein the control unit calculates the average value of the variable gradients per predetermined time of the outdoor temperature of the places where all the indoor units are installed.

20. The air conditioning system of claim 18, wherein the control unit calculates the average value of the variable gradients per predetermined time of the outdoor temperature of the places where the indoor units in operation are installed.

* * * * *